US009945583B2

(12) United States Patent
Prichard et al.

(10) Patent No.: US 9,945,583 B2
(45) Date of Patent: Apr. 17, 2018

(54) GAS FLOW CONTROLLER INCLUDING VALVE DECOUPLING MECHANISM

(71) Applicant: Emerson Electric Co., St. Louis, MO (US)

(72) Inventors: James B. Prichard, Dardenne Prairie, MO (US); Donald L. Blessing, Manchester, MO (US); Mark H. Stark, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 419 days.

(21) Appl. No.: 14/725,528

(22) Filed: May 29, 2015

(65) Prior Publication Data

US 2016/0348945 A1 Dec. 1, 2016

(51) Int. Cl.

| | |
|---|---|
| ***F23N 1/00*** | (2006.01) |
| ***F24H 9/20*** | (2006.01) |
| ***F24H 1/20*** | (2006.01) |

(52) U.S. Cl.

CPC ..... *F24H 9/2035* (2013.01); *F24H 1/205* (2013.01)

(58) Field of Classification Search

CPC ..... F23D 14/02
USPC ..... 431/58, 42
See application file for complete search history.

(56) References Cited

U.S. PATENT DOCUMENTS

| | | | | |
|---|---|---|---|---|
| 2,513,705 | A * | 7/1950 | Arden | F23Q 9/12 137/66 |
| 3,453,062 | A * | 7/1969 | McAllister | F23N 5/067 137/495 |
| 3,892,258 | A | 7/1975 | Hendrick | |
| 3,987,679 | A | 10/1976 | Condon et al. | |
| 4,026,314 | A | 5/1977 | Turner et al. | |
| 4,087,231 | A * | 5/1978 | Matthews | F23N 1/007 137/489 |
| 4,252,296 | A | 2/1981 | Berg | |
| 4,483,672 | A * | 11/1984 | Wallace | F23N 5/105 126/116 A |
| 5,209,253 | A | 5/1993 | Taylor | |
| 5,345,856 | A | 9/1994 | Willoughby | |
| 6,182,944 | B1 | 2/2001 | Veronese et al. | |
| 6,745,725 | B2 | 6/2004 | Toniolo et al. | |
| 6,776,388 | B2 | 8/2004 | Baumann | |
| 7,044,023 | B2 | 5/2006 | Toniolo et al. | |
| 7,066,203 | B2 | 6/2006 | Baarda | |
| 7,073,524 | B2 | 7/2006 | Chian | |

(Continued)

*Primary Examiner* — Avinash Savani
(74) *Attorney, Agent, or Firm* — Armstrong Teasdale LLP

(57) ABSTRACT

Gas flow controllers for use in gas fired apparatus including a pilot burner and a main burner are described. A controller includes a pilot valve moveable between a closed position and an open position to provide selective fluid communication between a gas inlet and the pilot burner, a main burner valve providing selective fluid communication between the gas inlet and the main burner, an actuator configured to open the pilot valve, a flow controller valve operable to open and close a fluid flow path between the gas inlet and a back side of the main burner valve upon actuation of the actuator, and a decoupling mechanism. The decoupling mechanism is configured to connect the actuator to the pilot valve and to selectively disconnect the actuator from the pilot valve when the actuator is actuated and a pressure differential across the pilot valve exceeds a threshold pressure limit.

17 Claims, 7 Drawing Sheets

(56) References Cited

U.S. PATENT DOCUMENTS

| | | | |
|---|---|---|---|
| 7,226,034 | B2 | 6/2007 | Stark et al. |
| 7,252,502 | B2 | 8/2007 | Munsterhuis |
| 7,435,081 | B2 | 10/2008 | Munsterhuis |
| 8,479,759 | B2 | 7/2013 | Benvenuto et al. |
| 8,944,404 | B2 | 2/2015 | Giacomini |
| 2010/0122733 | A1 | 5/2010 | Grygus et al. |
| 2012/0153200 | A1 | 6/2012 | Turrin et al. |
| 2012/0160186 | A1 | 6/2012 | Turrin |

* cited by examiner

GAS FLOW CONTROLLER INCLUDING VALVE DECOUPLING MECHANISM

FIELD

The field of the disclosure relates generally to gas fired apparatus, and more particularly, to gas flow controllers for use in gas fired apparatus.

BACKGROUND

Gas fired apparatus, such as residential gas fired water heaters, often include a main gas burner to provide heat for the apparatus, and a pilot burner that provides a standing pilot flame to ignite the main gas burner (e.g., for the first time or if the main burner flame goes out). In the case of water heaters, a main gas burner is used to heat water within a water tank of the water heater. A thermostat is typically provided to control the temperature of the water inside the tank and typically may be set within a particular range (e.g., warm, hot or very hot). A pilot burner provides a standing pilot flame to ignite the main gas burner.

To ignite the pilot flame in typical gas fired apparatus, a user holds a pilot valve open (e.g., with a depressible knob) to permit gas to flow to the pilot burner, and ignites the gas at the pilot burner with an ignition source, such as an electronic igniter or a match. A main burner valve which controls the flow of gas to the main burner is typically closed when the pilot light is being lit. However, abnormal operating conditions may cause the main burner valve to be open when the pilot light is being lit, allowing combustible gases to flow to the main burner and creating hazardous ignition conditions. Additionally, some gas flow controllers allow the pilot valve to be opened under abnormal operating conditions, such as an elevated pressure condition on the inlet or upstream side of the pilot valve. This may result in excessive gas flow to the pilot burner, and excessive strain on components of the gas flow controller that interconnect the pilot valve with a user input device used to actuate the pilot valve.

At least some known gas flow controllers lack redundancy during the pilot lighting sequence, or are subject to potential software failure modes. Additionally, at least some known gas flow controllers utilize electronically controlled valves and/or relatively large valves as safety features, which add to the size, complexity, and cost of the gas flow controllers. Moreover, some gas flow controllers control actuation of the pilot valve with an electro-magnet that draws power from a relatively limited power supply, such as a millivolt power source, used to control operation of the gas flow controller.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a gas flow controller for use in a gas fired apparatus including a pilot burner and a main burner is provided. The controller includes a pilot valve moveable between a closed position and an open position to provide selective fluid communication between a gas inlet and the pilot burner, a main burner valve providing selective fluid communication between the gas inlet and the main burner, an actuator configured to open the pilot valve upon actuation of the actuator, a flow controller valve operable to open and close a fluid flow path between the gas inlet and a back side of the main burner valve upon actuation of the actuator, and a decoupling mechanism. The decoupling mechanism is configured to connect the actuator to the pilot valve and to selectively disconnect the actuator from the pilot valve when the actuator is actuated and a pressure differential across the pilot valve exceeds a threshold pressure limit.

In another aspect, a gas flow controller for use in a gas fired apparatus including a pilot burner and a main burner is provided. The controller includes a pilot valve moveable between a closed position and an open position to provide selective fluid communication between a gas inlet and the pilot burner, a main burner valve providing selective fluid communication between the gas inlet and the main burner, an actuator configured to open the pilot valve upon actuation of the actuator, a flow controller valve operable to open and close a fluid flow path between the gas inlet and a back side of the main burner valve upon actuation of the actuator, and a decoupling mechanism interconnecting the actuator to the pilot valve. The decoupling mechanism is configured to limit an opening force applied to the pilot valve upon actuation of the actuator.

In yet another aspect, a gas flow controller for use in a gas fired apparatus including a pilot burner and a main burner is provided. The controller includes a pilot valve moveable between a closed position and an open position to provide selective fluid communication between a gas inlet and the pilot burner, an actuator configured to open the pilot valve upon actuation of the actuator, a main burner valve providing selective fluid communication between the gas inlet and the main burner, an interconnecting member having a first end connected to the pilot valve and a second end distal from the first end, and a decoupling mechanism. The interconnecting member is configured to pivot about a fulcrum to open and close the pilot valve. The decoupling mechanism includes a shaft, an engagement member slidably connected to the shaft, and a biasing element configured to bias the engagement member towards the interconnecting member. Actuation of the actuator causes the engagement member to engage the interconnecting member between the second end of the interconnecting member and the fulcrum, and apply a limited opening force to the pilot valve.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

DETAILED DESCRIPTION

Figure 1:
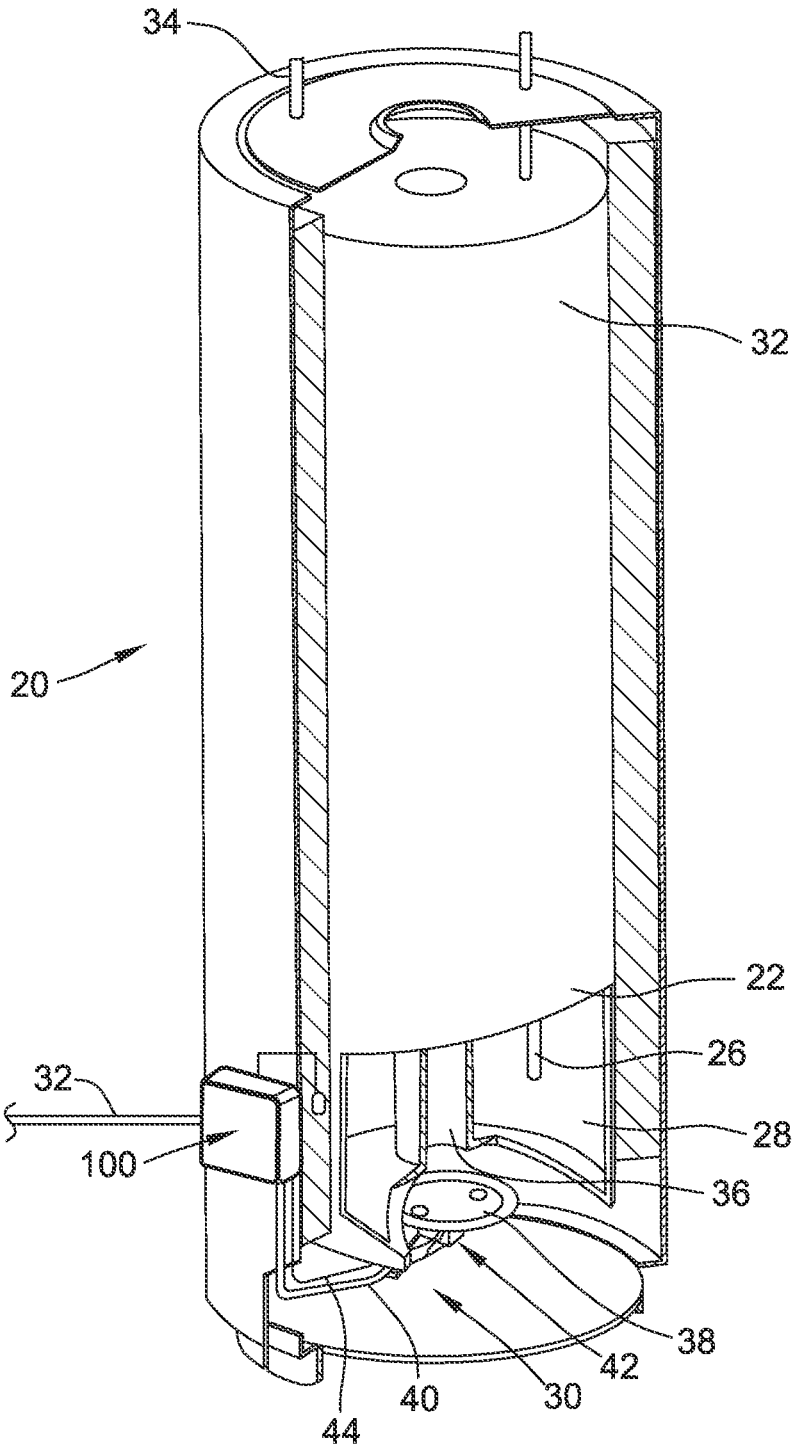
FIG. 1 is a cut-away view of a gas fired apparatus shown in the form of a water heater system, the water heater system including a gas flow controller for controlling the supply of gas in the water heater system.

Referring to FIG. 1, a gas fired apparatus illustrated in the form of a water heater system for heating and storing water is indicated generally at 20. Water heater system 20 generally includes a storage tank 22, a gas-fired burner assembly 30 positioned beneath storage tank 22 for heating water supplied to and stored in storage tank 22, and a controller 100 for controlling the supply of gas to main burner assembly 30. Storage tank 22 receives cold water via a cold water inlet 26 in a bottom portion 28 of storage tank 22. Cold water entering bottom portion 28 of storage tank 22 is heated by burner assembly 30. Water that is heated leaves storage tank 22 via a hot water outlet pipe 34. Combustion gases from burner assembly 30 leave water heater system 20 via a flue 36.

Controller 100 is connected to a gas supply (not shown) via a main gas supply line 32. Controller 100 is configured to control the supply of gas from main gas supply line 32 to burner assembly 30, as described in more detail herein.

Burner assembly 30 includes a main burner 38 connected to controller 100 via a gas supply line 40, and a pilot burner 42 for igniting main burner 38. Pilot burner 42 is also configured to detect whether a pilot flame is present or extinguished, and communicate with controller 100 via connection 44 to control the supply of gas to main burner 38 (e.g., by shutting off the supply of gas if no pilot flame is detected).

Figure 2:
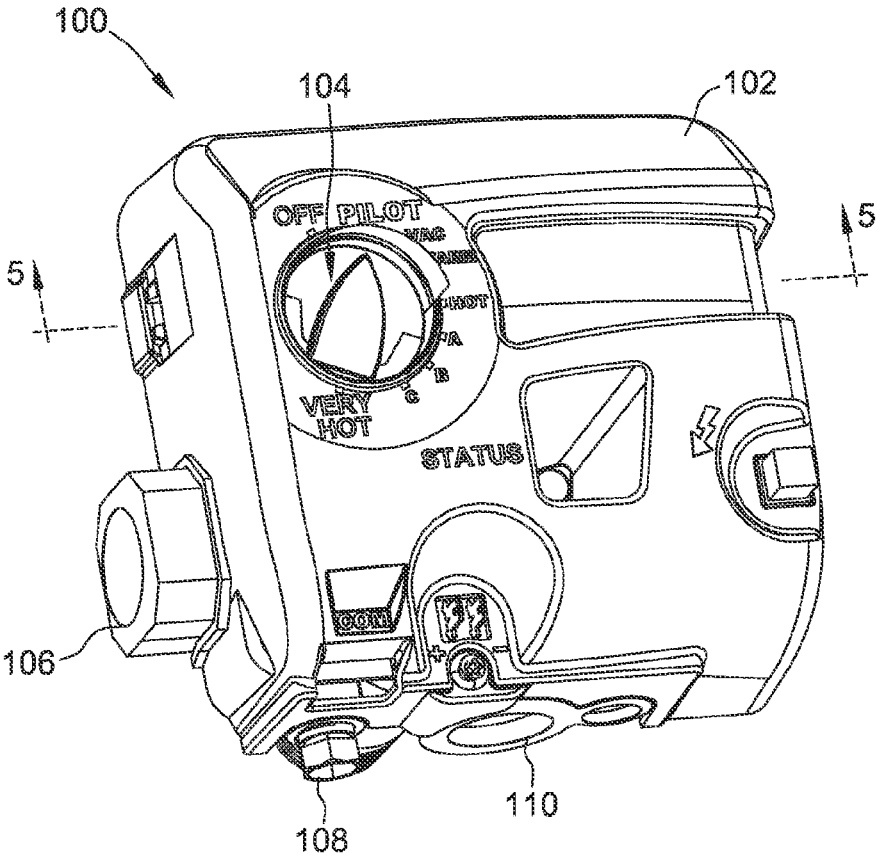
FIG. 2 is a perspective view of the controller shown in FIG. 1.
Figure 3:
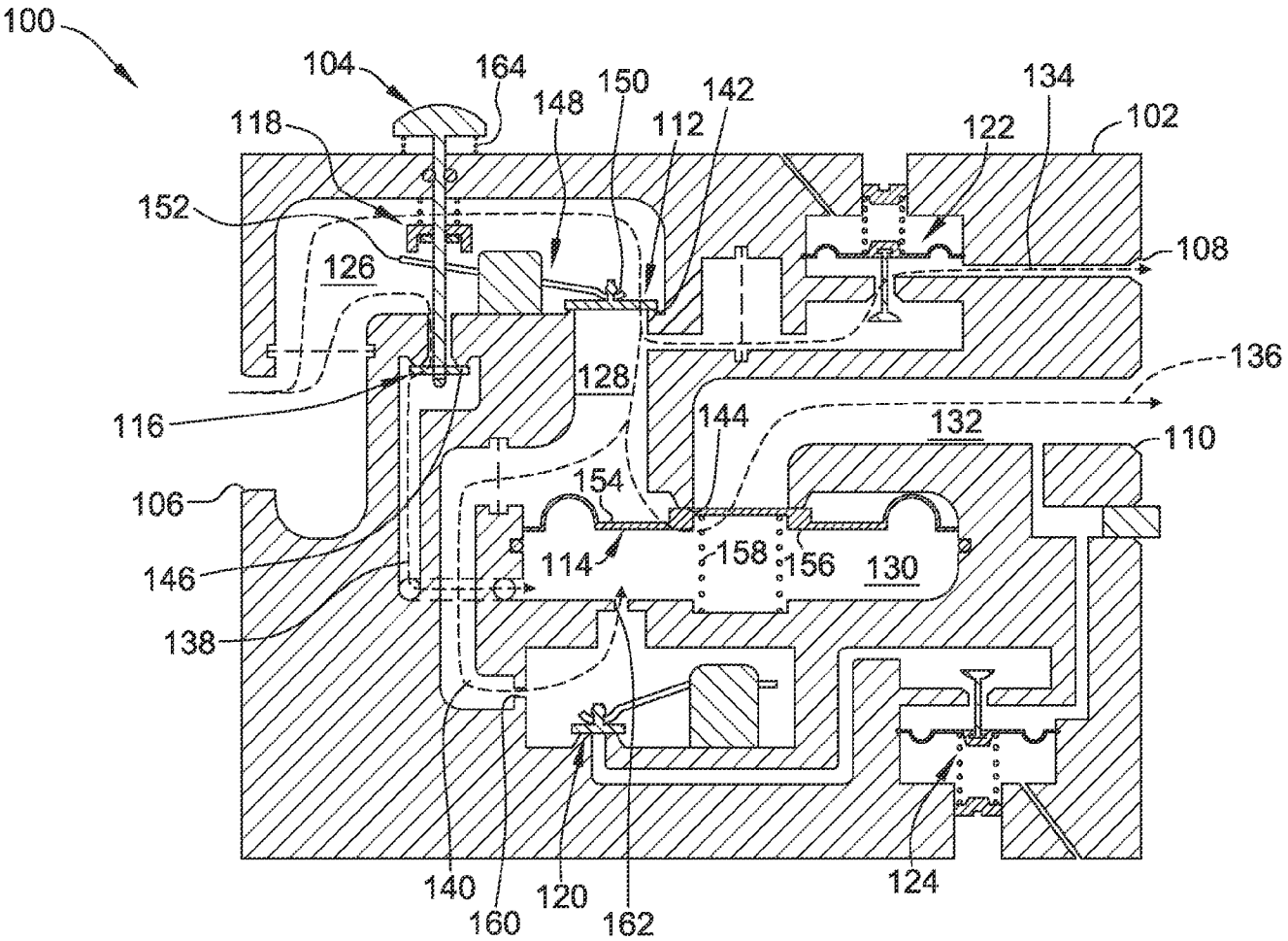
FIG. 3 is a schematic cross-section of the controller shown in FIG. 2.

FIG. 2 is a perspective view of controller 100, and FIG. 3 is a schematic cross-section of controller 100. As shown in FIGS. 2 and 3, controller 100 includes a housing 102, an input device 104, a gas inlet 106, a pilot burner outlet 108, a main burner outlet 110, a pilot valve 112 (broadly, a first valve), a main burner valve 114 (broadly, a second valve), a flow controller valve 116 (broadly, a third valve), and a decoupling mechanism 118. Controller 100 is configured to control the supply of gas to pilot burner 42 and main burner 38 (both shown in FIG. 1) through pilot burner outlet 108 and main burner outlet 110, respectively, based on an operational state of controller 100.

In the example embodiment, controller 100 also includes a pressure control valve 120 configured to open and close main burner valve 114 by regulating a pressure differential across main burner valve 114. Controller 100 also includes a pilot burner flow regulator 122 and a main burner flow regulator 124 configured to control the flow rate of gas to the pilot burner 42 and main burner 38 (both shown in FIG. 1), respectively. Controller 100 may also include an electronic controller (not shown) configured to send and receive electronic signals to and from one or more electronic components of water heater system 20.

As shown in FIG. 3, housing 102 defines gas inlet 106, pilot burner outlet 108, and main burner outlet 110. Housing 102 also defines a plurality of fluid flow paths and chambers that fluidly connect gas inlet 106, pilot burner outlet 108, and main burner outlet 110 to one another. In the example embodiment, housing 102 defines a first fluid chamber 126, a second fluid chamber 128, a third fluid chamber 130, and a fourth fluid chamber 132. Additionally, housing 102 defines a first fluid flow path 134 from gas inlet 106 to pilot burner outlet 108, a second fluid flow path 136 from gas inlet 106 to main burner outlet 110, a third fluid flow path 138 from gas inlet 106 to a back side of main burner valve 114 and third fluid chamber 130, and a fourth fluid flow path 140 from second fluid chamber 128 to third fluid chamber 130. A portion of housing 102 defining third fluid flow path 138 is illustrated in broken lines in FIG. 3 to indicate that third fluid flow path 138 extends out of the plane in which the schematic cross-section is taken. Third fluid flow path 138 is illustrated in this way to indicate that third fluid flow path 138 does not intersect fourth fluid flow path 140 along the portion illustrated in broken lines.

Housing 102 also defines a first valve seat 142 configured to sealingly engage pilot valve 112 to inhibit gas flow from first fluid chamber 126 to second fluid chamber 128, a second valve seat 144 configured to sealingly engage main burner valve 114 to inhibit gas flow from gas inlet 106 to main burner outlet 110, and a third valve seat 146 configured to sealingly engage flow controller valve 116 to inhibit gas flow from first fluid chamber 126 to third fluid chamber 130.

Gas inlet 106 is configured to be connected to main gas supply line 32 (shown in FIG. 1), and to receive gas from main gas supply line 32. Pilot burner outlet 108 is configured to be fluidly connected to pilot burner 42 (shown in FIG. 1) to supply gas thereto. Main burner outlet 110 is configured to be fluidly connected to main burner 38 (shown in FIG. 1) to supply gas thereto.

Pilot valve 112 is configured to control the flow of gas from gas inlet 106 to pilot burner outlet 108. More specifically, pilot valve 112 is moveable between an open position, in which gas is permitted to flow from gas inlet 106 to pilot burner outlet 108, and a closed position (shown in FIG. 3) in which pilot valve 112 sealingly engages first valve seat 142 and inhibits gas flow from gas inlet 106 to pilot burner outlet 108.

Pilot valve 112 is operably connected to an interconnecting member 148 that is operable to open pilot valve 112 upon actuation of input device 104, as described in more detail herein. Interconnecting member 148 includes a first end 150 connected to pilot valve 112, and a second end 152 distal from first end 150 of interconnecting member 148. Interconnecting member 148 is configured to pivot about a fulcrum (not shown in FIG. 3) to cause pilot valve 112 to open and close. Controller 100 may also include a pilot valve spring or biasing element (not shown in FIG. 3) configured to bias the pilot valve 112 towards the closed position.

Pilot valve 112 separates first fluid chamber 126 from second fluid chamber 128, and provides selective fluid communication between first fluid chamber 126 and second fluid chamber 128 by moving between the open position and the closed position. Pilot valve 112 also provides selective fluid communication between gas inlet 106, which is fluidly connected to first fluid chamber 126, and pilot burner outlet 108, which is fluidly connected to second fluid chamber 128. When pilot valve 112 is in the open position, gas supplied to gas inlet 106 (e.g., by main gas supply line 32, shown in FIG. 1) flows from gas inlet 106 along first fluid flow path 134 to pilot burner outlet 108. Pilot valve 112 is operable to open and close first fluid flow path 134 by moving between the open and closed positions. Further, when pilot valve 112 is in the open position, gas supplied to gas inlet 106 is permitted to flow along fourth fluid flow path 140, which fluidly connects second fluid chamber 128 to third fluid chamber 130.

Main burner valve 114 is configured to control the flow of gas from gas inlet 106 to main burner 38 via main burner outlet 110. More specifically, main burner valve 114 is moveable between an open position, in which gas is permitted to flow from gas inlet 106 to main burner outlet 110, and a closed position (shown in FIG. 3) in which main burner valve 114 inhibits gas flow from gas inlet 106 to main burner outlet 110. In the example embodiment, main burner valve 114 is a diaphragm valve, although main burner valve 114 may be any suitable valve that enables controller 100 to function as described herein.

Main burner valve 114 includes a front side 154 and an opposing back side 156. Front side 154 is configured to sealingly engage second valve seat 144 defined by housing 102 to inhibit gas flow from gas inlet 106 to main burner outlet 110. Main burner valve 114 may be opened and closed by regulating a pressure differential across front side 154 and back side 156 of main burner valve 114. Controller 100 includes a main burner valve spring 158 (broadly, a biasing element) configured to bias main burner valve 114 towards the closed position. Main burner valve spring 158 engages back side 156 of main burner valve 114, and exerts a biasing force on back side 156 of main burner valve 114.

Main burner valve 114 separates second fluid chamber 128 from third fluid chamber 130. Second fluid chamber 128 is in fluid communication with front side 154 of main burner valve 114, and third fluid chamber 130 is in fluid communication with back side 156 of main burner valve 114. Second fluid chamber 128 is fluidly connected to third fluid chamber 130 by fourth fluid flow path 140, which includes a first pressure regulating orifice 160 and a second pressure regulating orifice 162. First and second pressure regulating orifices 160 and 162 are configured to regulate a pressure on back side 156 of main burner valve 114 to facilitate opening and closing main burner valve 114.

Main burner valve 114 also separates second fluid chamber 128 from fourth fluid chamber 132, and provides selective fluid communication between second fluid chamber 128 and fourth fluid chamber 132 by moving between the closed position and the open position. Main burner valve 114 also provides selective fluid communication between second fluid chamber 128 and main burner outlet 110, which is fluidly connected to fourth fluid chamber 132. When main burner valve 114 and pilot valve 112 are in the open position (not shown in FIG. 3), gas supplied to gas inlet 106 flows from gas inlet 106 along second fluid flow path 136 to main burner outlet 110. Main burner valve 114 is operable to open and close second fluid flow path 136 by moving between the open and closed positions.

Flow controller valve 116 is configured to control the flow of gas from gas inlet 106 to back side 156 of main burner valve 114 through third fluid flow path 138 which provides inlet pressure gas directly to back side 156 of main burner valve 114. More specifically, flow controller valve 116 is moveable between an open position, in which gas is permitted to flow from gas inlet 106 through third fluid flow path 138 to back side 156 of main burner valve 114, and a closed position in which flow controller valve 116 inhibits gas flow through third fluid flow path 138 to back side 156 of main burner valve 114. As shown in FIG. 3, gas flow is still permitted to the back side 156 of main burner valve 114 along fourth fluid flow path 140 even when flow controller valve 116 is in the closed position. Controller 100 may also include a flow controller valve spring or biasing element (not shown in FIG. 3) configured to bias flow controller valve 116 towards the closed position.

Flow controller valve 116 provides selective fluid communication between first fluid chamber 126 and third fluid chamber 130 by moving between the open position (not shown in FIG. 3) and the closed position (shown in FIG. 3). Flow controller valve 116 also provides selective fluid communication between gas inlet 106, which is fluidly connected to first fluid chamber 126, and back side 156 of main burner valve 114, which is in fluid communication with third fluid chamber 130. When flow controller valve 116 is in the open position, gas supplied to gas inlet 106 flows from gas inlet 106 along third fluid flow path 138 to third fluid chamber 130. In other words, when flow controller valve 116 is open, inlet pressure gas is supplied to back side 156 of main burner valve 114 through third fluid flow path 138. Flow controller valve 116 is operable to open and close third fluid flow path 138 by moving between the open and closed positions.

Input device 104 is configured to receive an input from a user of controller 100, such as a desired water temperature of water stored within storage tank 22 (shown in FIG. 1). In some embodiments, for example, input device 104 includes a rotary device accessible from an exterior of housing 102 that enables a user to select one of a plurality of temperature setpoints that correspond to a desired temperature of water stored within storage tank 22 (shown in FIG. 1). Controller 100 is configured to control the supply of gas to main burner 38 (shown in FIG. 1) based at least in part on a user input received at input device 104.

In the illustrated embodiment, input device 104 is also an actuator configured to open both pilot valve 112 and flow controller valve 116. Accordingly, input device 104 is interchangeably referred to herein as an actuator or actuating device. In other embodiments, controller 100 may include an actuating device separate from input device 104 for opening pilot valve 112 and flow controller valve 116.

Input device 104 is configured to open and close pilot valve 112 and flow controller valve 116. More specifically, input device 104 is movable from a first position (shown in FIG. 3) to a second position in which input device 104 is operably connected to pilot valve 112 and flow controller valve 116 to open pilot valve 112 and flow controller valve 116. In the illustrated embodiment, input device 104 is a manually actuated actuator. Specifically, input device 104 is depressible or movable (e.g., by a user) from the first position to the second position. In other embodiments, controller 100 may include an automated actuator (e.g., a solenoid) that is actuated in response to receiving an electrical signal to open or close the pilot valve 112. Under normal operating conditions, input device 104 is configured to open both pilot valve 112 and flow controller valve 116 when input device 104 is actuated from the first position to the second position. Thus, when a user actuates input device 104 during a pilot ignition sequence, flow controller valve 116 is opened by actuation of input device 104, and permits inlet pressure gas to flow directly to back side 156 of main burner valve 114. Flow controller valve 116 and third fluid flow path 138 thereby facilitate maintaining main burner valve 114 in the closed position, inhibiting gas flow to main burner 38 when a pilot flame is being lit, and reducing the risk of hazardous ignition conditions. As described in more detail herein, decoupling mechanism 118 is configured to selectively disconnect input device 104 from pilot valve 112 under certain conditions, such as an elevated pressure condition on the upstream or inlet side of pilot valve 112, to prevent pilot valve 112 from opening.

In some embodiments, input device 104 may be keyed with housing 102 such that input device 104 is only depressible or movable when oriented in certain positions. An input device spring 164 (broadly, a biasing element) biases input device 104 towards the first position such that the input device 104 does not exert an opening force on pilot valve 112 or flow controller valve 116 in the absence of an applied force.

Decoupling mechanism 118 operably connects input device 104 to pilot valve 112, and is configured to limit the amount of opening force that can be applied to pilot valve 112 via interconnecting member 148 when input device 104 is depressed by a user. More specifically, decoupling mechanism 118 is configured to selectively disconnect input device 104 from interconnecting member 148 and pilot valve 112 when input device 104 is actuated and a pressure differential across pilot valve 112 exceeds a threshold pressure limit. Thus, when input device 104 is actuated from the first position to the second position, and the pressure differential across pilot valve 112 exceeds the threshold pressure limit, decoupling mechanism 118 prevents pilot valve 112 from opening (i.e., pilot valve 112 remains in the closed position).

Figure 4:
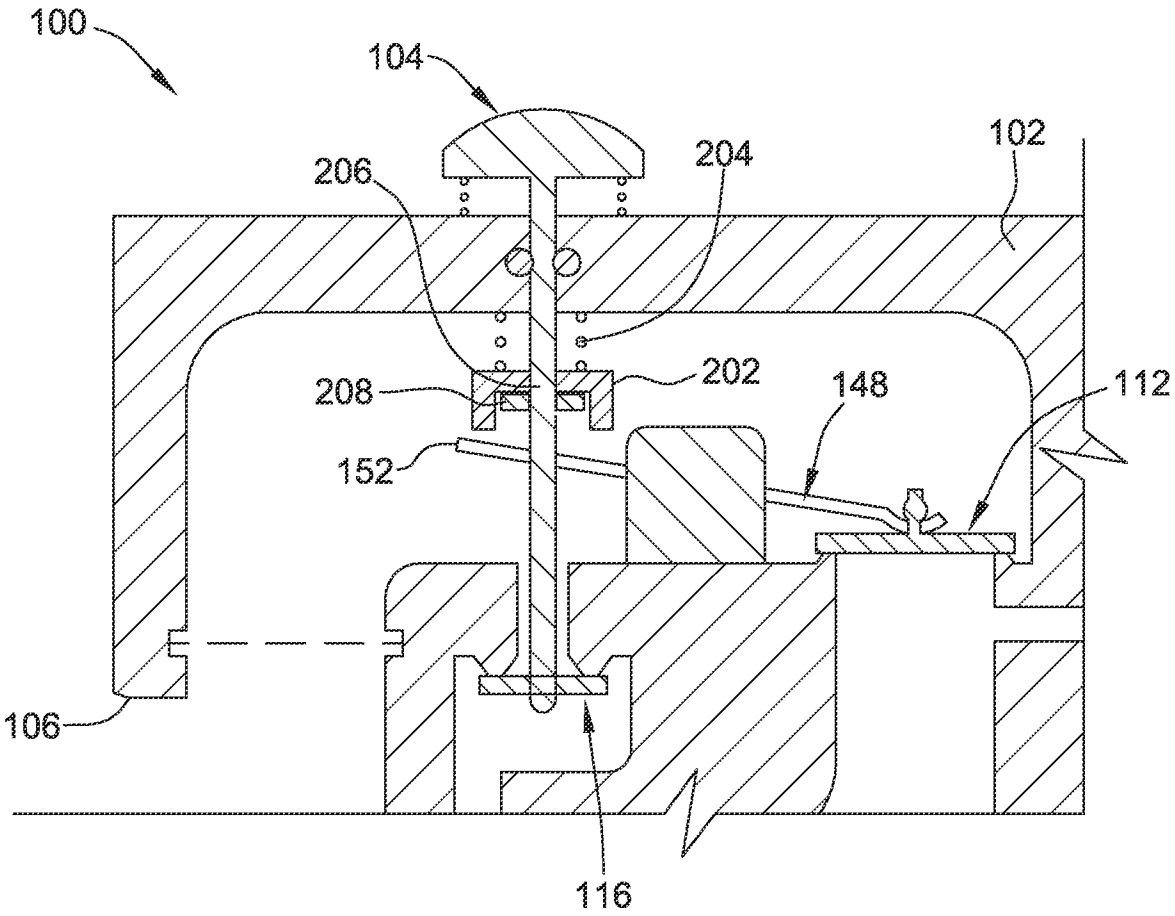
FIG. 4 is an enlarged view of a portion of the controller shown in FIG. 3.

FIG. 4 is an enlarged view of a portion of controller 100 shown in FIG. 3. As shown in FIG. 4, decoupling mechanism 118 includes an engagement member 202 and a decoupling spring 204 (broadly, a biasing element) configured to bias engagement member 202 towards and into engagement with interconnecting member 148. Decoupling mechanism 118 also includes a shaft 206 that moves in response to actuation of input device 104. Shaft 206 is illustrated as a portion of input device 104 in the schematic cross-section illustrated in FIG. 4, although shaft 206 may be separate from input device 104 (see, e.g., FIG. 5).

Engagement member 202 is slidably connected to shaft 206. Moreover, engagement member 202 is movable from a first position (shown in FIG. 4) to a second position in which engagement member 202 engages interconnecting member 148 and exerts an opening force on pilot valve 112 via interconnecting member 148. The decoupling spring 204 biases the engagement member 202 towards the second position.

Shaft 206 includes a retaining element 208 configured to inhibit movement of engagement member 202 along shaft 206 in a first direction, and permit movement of engagement member 202 along shaft 206 in a second direction opposite the first direction. Decoupling mechanism 118 may also include one or more biasing elements (not shown in FIG. 4) configured to exert a biasing force on shaft 206 or retaining element 208 to counter-act the biasing force of decoupling spring 204, and thereby retain engagement member 202 in the first position (shown in FIG. 4) in the absence of an applied force. Decoupling spring 204 biases engagement member 202 towards retaining element 208, and maintains engagement between retaining element 208 and engagement member 202 at least until engagement member 202 engages interconnecting member 148.

Retaining element 208 is operably connected to input device 104 such that actuation of input device 104 moves retaining element 208 from a first position to second position to enable engagement member 202 to move into engagement with interconnecting member 148. More specifically, actuation of input device 104 from the first position to the second position moves retaining element 208 such that engagement member 202 can engage interconnecting member 148 under the force of decoupling spring 204. Engagement member 202 engages interconnecting member 148 between second end 152 of interconnecting member 148 and the fulcrum about which interconnecting member 148 pivots. Engagement member 202 thereby exerts an opening force on interconnecting member 148, creating a rotational moment around the fulcrum. Decoupling spring 204 has a suitable biasing force such that, under normal operating conditions (e.g., in the absence of an elevated pressure condition on the inlet side of pilot valve 112), the opening force on pilot valve 112 resulting from the rotational moment on interconnecting member 148 is sufficient to overcome other forces biasing pilot valve 112 towards the closed position, and move pilot valve 112 from the closed position to the open position. That is, the rotational moment on interconnecting member 148 resulting from the biasing force of decoupling spring 204 is sufficient to overcome the counter-acting rotational moment on interconnecting member 148 resulting from a pressure differential across pilot valve 112 and other biasing elements biasing pilot valve 112 towards the closed position.

Moreover, the biasing force of decoupling spring 204 is set so as to limit the magnitude of opening force that can be applied to pilot valve 112 via interconnecting member 148. More specifically, the biasing force of decoupling spring 204 is set such that, when the pressure differential across pilot valve 112 exceeds a threshold pressure limit, the biasing force of decoupling spring 204 and the resulting opening force exerted on interconnecting member 148 by engagement member 202 are insufficient to open pilot valve 112. That is, the rotational moment on interconnecting member 148 resulting from the biasing force of decoupling spring 204 is insufficient to overcome the counter-acting rotational moment on interconnecting member 148 resulting from the pressure differential across pilot valve 112 and other biasing elements biasing pilot valve 112 towards the closed position. Thus, when input device 104 is actuated and an elevated pressure condition exists on the inlet side of pilot valve 112, engagement member 202 engages interconnecting member 148 but does not open pilot valve 112. Moreover, engagement member 202 is slidably connected to shaft 206 such that actuation of input device 104 causes shaft 206 to slide relative to engagement member 202 and operably engage and actuate flow controller valve 116, even when the pressure differential across pilot valve 112 exceeds the threshold pressure limit.

The biasing force of decoupling spring 204 may be selected based upon, among other things, the desired pressure differential above which the decoupling mechanism 118 will prevent pilot valve 112 from opening, the distance between the pivot fulcrum of interconnecting member 148 and pilot valve 112, and the distance between the pivot fulcrum and the location of interconnecting member 148 at which engagement member 202 engages interconnecting member 148.

In operation, controller 100 is used to control the supply of gas to pilot burner 42 and main burner 38 (both shown in FIG. 1) during different operational states of controller 100. The operational states of controller 100 include, for example, an off state, a pilot ignition state, a standby state, and a "main burner on" state. In the pilot ignition state, controller 100 is used to safely ignite a pilot flame (e.g., for the first time or after the pilot flame has been extinguished). More specifically, in the pilot ignition state, pilot valve 112 is held open such that gas supplied by main gas supply line 32 (shown in FIG. 1) flows from gas inlet 106 along first fluid flow path 134 to pilot burner outlet 108. Gas is supplied to pilot burner 42 (shown in FIG. 1) from pilot burner outlet 108, and is ignited by an igniter (not shown) included in pilot burner 42. Under normal operating conditions, main burner 38 is in the closed position during the pilot ignition state.

When a pilot flame is detected at pilot burner 42 (e.g., by a thermo-electric device, such as a thermopile), controller 100 enters the standby state. In the standby state, pilot valve 112 is held in the open position by (e.g., by an electromagnetic latch) such that gas is continuously supplied to pilot burner 42 (shown in FIG. 1) through pilot burner outlet 108. More specifically, in the example embodiment, a thermo-electric device generates a signal to an electronic controller within controller 100 indicating the presence of a pilot flame at pilot burner 42 (shown in FIG. 1), and the electronic controller transmits a signal to an electromagnetic latch to hold pilot valve 112 in the open position.

Controller 100 enters the "main burner on" state when controller 100 receives a signal to ignite main burner 38 (shown in FIG. 1). Main burner valve 114 may be actuated by regulating a pressure differential across front side 154 and back side 156 using pressure control valve 120.

When controller 100 determines the supply of gas to main burner 38 should be shut off (e.g., by receiving a signal from a thermostat that a water temperature of water within storage tank 22 has reached a threshold temperature), main burner valve 114 is closed. Additional details of the standby and "main burner on" states of controller 100, and related functionality and components of controller 100, are described in more detail in U.S. patent application Ser. No. 14/276,507, filed on May 13, 2014, the entire disclosure of which is hereby incorporated by reference.

Figure 5:
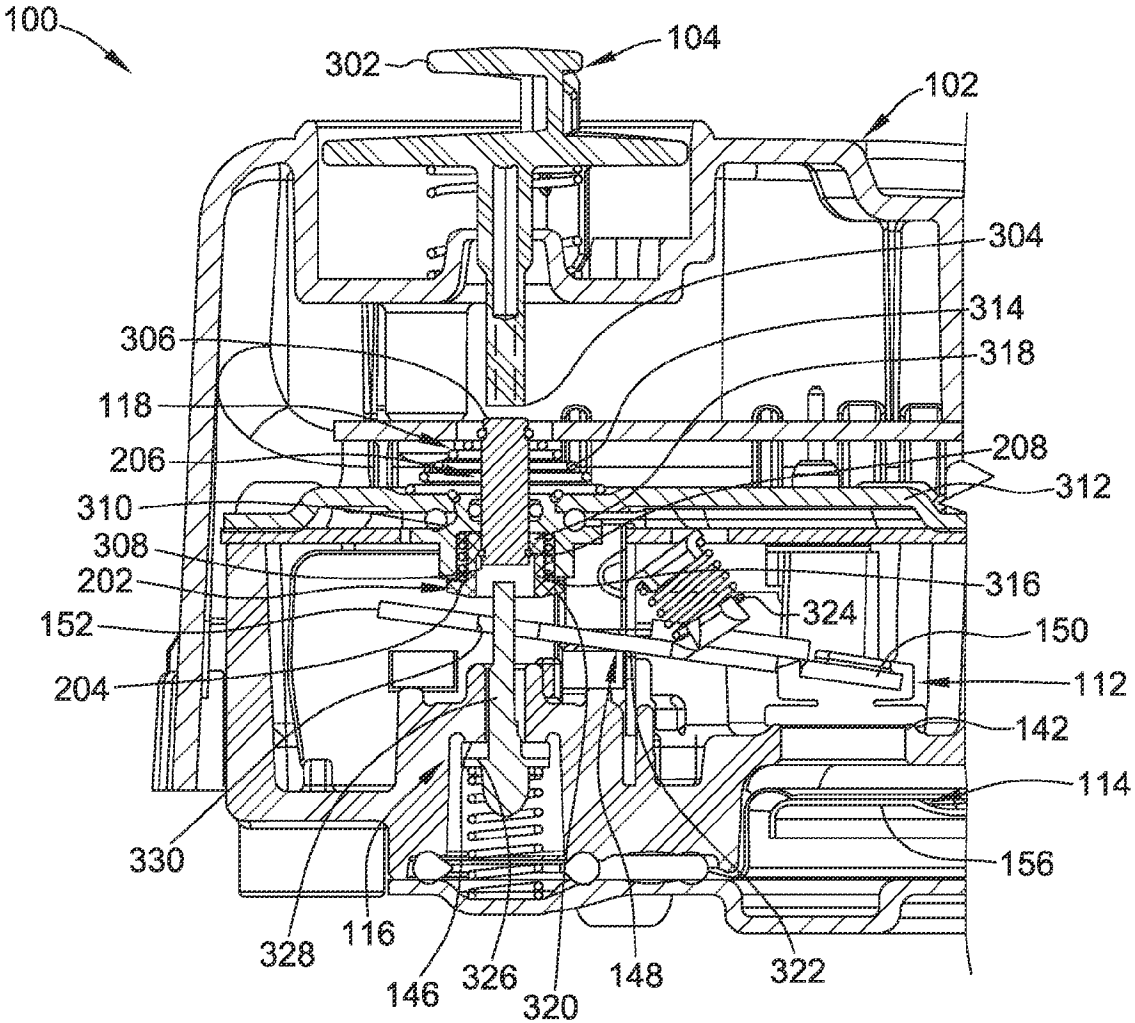
FIG. 5 is a partial cross-section of the controller shown in FIG. 2 taken along line "5-5" in FIG. 2.

FIG. 5 is partial cross-section of the example controller 100 taken along line "5-5" in FIG. 2, illustrating additional details of controller 100. Components of controller 100 shown in FIG. 5 are identified using the same reference numerals as used in FIGS. 2-4.

In the example embodiment, input device 104 is a manually depressible knob including a first end 302 configured to be manually actuated by a user of controller 100, and an opposing second end 304 configured to engage decoupling mechanism 118 (specifically, shaft 206). In the example embodiment, shaft 206 is shown as a separate component from input device 104 although, as noted above, shaft 206 may be part of input device 104 (i.e., integrally formed with input device 104).

Moreover, shaft 206 includes a first end 306 configured to engage second end 304 of input device 104, and a second end 308 opposite first end 306. Second end 308 of shaft 206 includes retaining element 208, which, in the example embodiment, is shown as a retaining ring extending radially outward from shaft 206. In other embodiments, retaining element 208 may include any suitable retaining structure that enables controller 100 to function as described herein. Shaft 206 extends from first end 306 through an aperture 310 defined in a wall 312 of housing 102 to second end 308.

As shown in FIG. 5, decoupling mechanism 118 includes a shaft spring 314 that exerts a biasing force on shaft 206 that generally opposes or counter-acts the biasing force of decoupling spring 204. Shaft spring 314 is disposed between first end 306 of shaft 206 and wall 312 of housing 102. In the example embodiment, the biasing force of shaft spring 314 is generally greater than the biasing force of decoupling spring 204 such that engagement member 202 is retained in the first position (shown in FIG. 5) in the absence of an applied force (e.g., from input device 104).

In the example embodiment, engagement member 202 includes a cylindrical tubular member 316 and an annular retaining lip 318 that extends radially inward from tubular member 316 and engages retaining element 208. Engagement member 202 also includes an engagement lip 320 that extends radially outward from tubular member 316 and engages decoupling spring 204. As shown in FIG. 5, decoupling spring 204 is disposed between wall 312 of housing 102 and engagement lip 320, and exerts a biasing force on engagement lip 320. Engagement member 202 is configured to engage interconnecting member 148 between second end 152 of interconnecting member 148 and a fulcrum 322 defined by housing 102 about which interconnecting member 148 pivots.

In the example embodiment, controller 100 also includes a pilot valve spring 324 that engages interconnecting member 148 between fulcrum 322 and first end 150 of interconnecting member 148, and biases pilot valve 112 towards the closed position.

As shown in FIG. 5, the flow controller valve 116 of the illustrated embodiment includes a valve member 326 configured to sealingly engage third valve seat 146 defined by housing 102, and a valve stem 328 extending away from valve member 326 and through an aperture 330 defined in interconnecting member 148. Valve stem 328 is configured to engage second end 308 of shaft 206 when input device 104 is actuated from the first position to the second position, such that actuation of input device 104 causes flow controller valve 116 to open regardless of the pressure differential across pilot valve 112. Although valve stem 328 is illustrated as extending through aperture 330 in the example embodiment, in other embodiments, second end 308 of shaft 206 may extend through aperture 330 in interconnecting member 148 to effect engagement between shaft 206 and valve stem 328.

Figure 6:
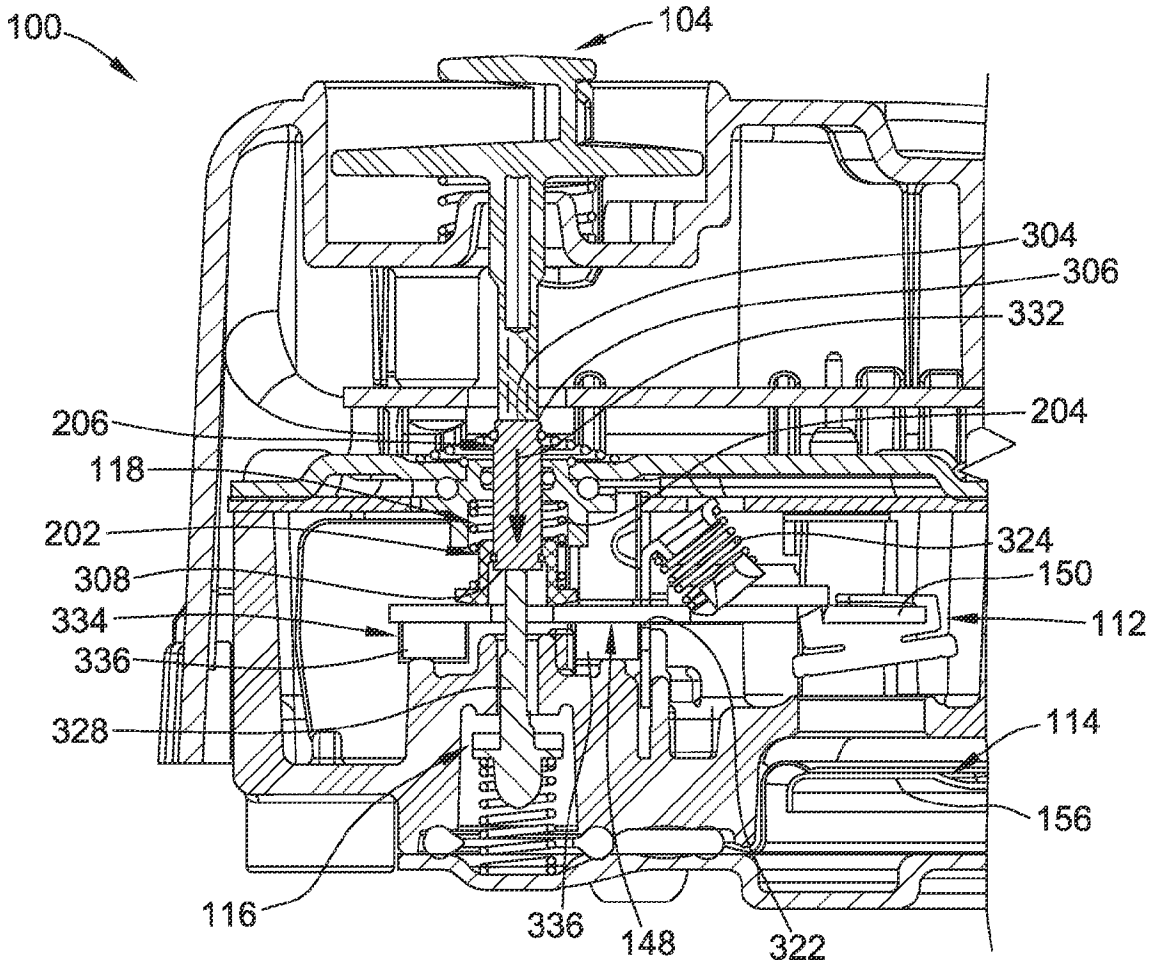
FIG. 6 shows the controller of FIG. 5 in a pilot ignition state under normal operating conditions.

FIG. 6 shows controller 100 in a pilot ignition state under normal operating conditions (e.g., in the absence of an elevated pressure condition on the upstream or inlet side of pilot valve 112). Under normal operating conditions, when input device 104 is actuated from the first position to the second position (shown in FIG. 6), pilot valve 112 is opened. More specifically, when input device 104 is actuated, second end 304 of input device 104 engages first end 306 of shaft 206, causing shaft 206 to move in a generally downward direction (broadly, a first direction), indicated by arrow 332 in FIG. 6. As shaft 206 moves in the downward direction 332, engagement member 202 moves downward with shaft 206 under the biasing force of decoupling spring 204. Shaft 206 and engagement member 202 continue moving in the downward direction 332 until engagement member 202 engages interconnecting member 148. Engagement member 202 exerts an opening force on interconnecting member 148, creating a rotational moment around fulcrum 322. The biasing force of decoupling spring 204 is set such that, under normal operating conditions, the opening force and rotational moment exerted on interconnecting member 148 by engagement member 202 is sufficient to open pilot valve 112. The relative strength and position of each spring acting on interconnecting member 148 (e.g., decoupling spring 204 and pilot valve spring 324) may be set such that the pilot valve 112 is configured to open when the pressure differential across pilot valve 112 (i.e., from the upstream side of pilot valve 112 to the downstream side of pilot valve 112) is below a threshold pressure limit.

In the example embodiment, an electromagnetic latch 334 maintains the pilot valve 112 in the opened position once the pilot light is lit. Specifically, when the pilot light is lit, a thermo-electric device (e.g., a thermopile) generates a signal to an electronic controller (not shown) indicating the presence of a pilot flame at pilot burner 42 (shown in FIG. 1), and the electronic controller transmits a signal to the electromagnetic latch 334 to magnetize electromagnets 336. In some embodiments, power generated by the thermo-electric device is used to power the electromagnet latch 334. The electromagnets 336 generate a magnetic field that interacts with interconnecting member 148, which in the example embodiment is constructed from a magnetically active material (e.g. steel). When the input device 104 moves from the second position to the first position, the engagement member 202 disengages the interconnecting member 148, and the magnetic attraction between the electromagnets 336 and the interconnecting member 148 hold the pilot valve 112 in the open position.

As shown in FIG. 6, actuation of input device 104 from the first position to the second position also causes flow controller valve 116 to open, such that third fluid flow path 138 (shown in FIG. 3) is open. More specifically, when input device 104 is actuated from the first position to the second position, second end 308 of shaft 206 engages valve stem 328 of flow controller valve 116 and moves flow controller valve 116 from the closed position to the opened position (shown in FIG. 6). Thus, input device 104 is configured to open both pilot valve 112 and flow controller valve 116 when input device 104 is moved from the first position to the second position and the pressure differential across pilot valve 112 is less than the threshold pressure limit. As a result, gas supplied to gas inlet 106 is permitted to flow through third fluid flow path 138 into third fluid chamber 130 and to back side 156 of main burner valve 114. Third fluid flow path 138 is configured (e.g., size and shaped) to permit sufficient fluid flow to back side 156 of main burner valve 114 such that the resulting pressure on back side 156 of main burner valve 114 combined with the biasing force of main burner valve spring 158 is sufficient to maintain main burner valve 114 in the closed position, even under abnormal operating conditions. (e.g., where one or both of pressure regulating orifices 160 and 162 are blocked, or where pressure control valve 120 is open in the pilot ignition state). The configuration of flow controller valve 116 and third fluid flow path 138 thereby facilitates maintaining main burner valve 114 in the closed position, and inhibiting gas flow to main burner 38 (shown in FIG. 1) when a pilot flame is being lit.

Figure 7:
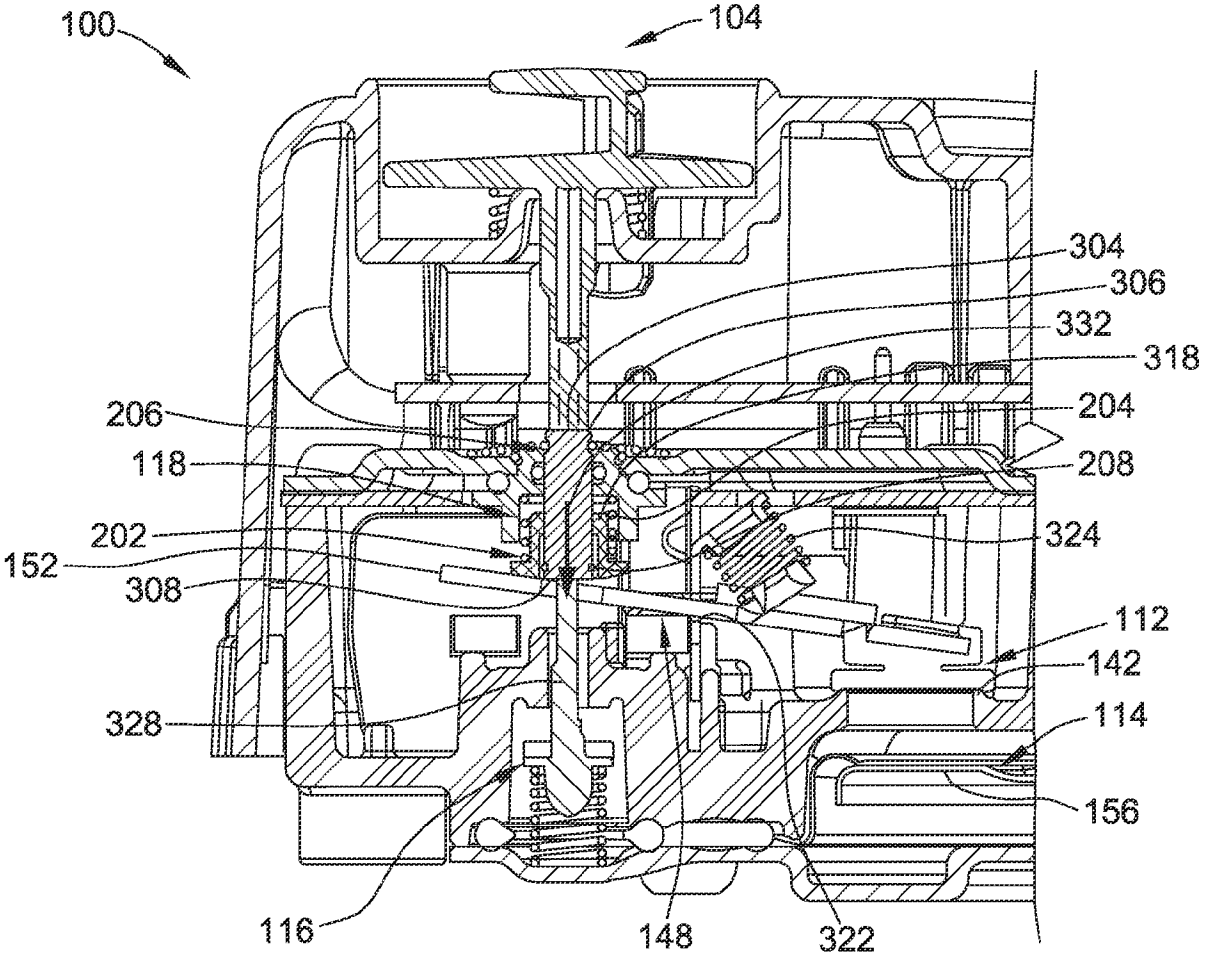
FIG. 7 shows the controller of FIG. 5 in an attempted pilot ignition state under abnormal operating conditions.

FIG. 7 shows controller 100 in an attempted pilot ignition state under abnormal operating conditions. More specifically, FIG. 7 shows the controller 100 in a state in which an elevated pressure condition exists on the upstream side of pilot valve 112 (i.e., the pressure differential across pilot valve 112 exceeds a threshold pressure limit).

As shown in FIG. 7, when input device 104 is actuated from the first position to the second position and an elevated pressure condition exists on the upstream or inlet side of pilot valve 112, decoupling mechanism 118 prevents pilot valve 112 from opening by operably disconnecting input device 104 from pilot valve 112. More specifically, when input device 104 is actuated from the first position to the second position, second end 304 of input device 104 engages first end 306 of shaft 206, and moves shaft 206 in the downward direction 332. As shaft 206 moves in the downward direction 332, engagement member 202 moves downward with shaft 206 under the biasing force of decoupling spring 204 until engagement member 202 engages interconnecting member 148. Under the elevated pressure condition shown in FIG. 7, the rotational moment on interconnecting member 148 resulting from the opening force of engagement member 202 is less than the sum of counter-acting rotational moments acting on interconnecting member 148. In the example embodiment, the rotational moments counter-acting the rotational moment from engagement member 202 include the force on pilot valve 112 resulting from the pressure differential across pilot valve 112 and the biasing force on interconnecting member 148 from pilot valve spring 324, although other embodiments may include other rotational moments (e.g., from additional springs or biasing elements). As a result, interconnecting member 148 inhibits further downward movement of engagement member 202, causing engagement member 202 to disengage retaining element 208 and operably disconnect input device 104 from pilot valve 112.

Decoupling mechanism 118 also enables flow controller valve 116 to be opened by actuation of input device 104, even under an elevated pressure condition. As shown in FIG. 7, for example, the connection between engagement member 202 and shaft 206 enables shaft 206 to slide relative to engagement member 202 and continue moving in the downward direction 332 after engagement member 202 engages interconnecting member 148. In particular, and as noted above, retaining element 208 is configured to inhibit movement of engagement member 202 along shaft 206 in a first direction, and permit movement of engagement member 202 along shaft 206 in a second direction opposite the first direction. Thus, as input device 104 is further actuated, shaft 206 continues moving in the downward direction 332 and retaining element 208 disengages retaining lip 318 of engagement member 202. Second end 308 of shaft 206 engages valve stem 328 of flow controller valve 116, and causes flow controller valve 116 to open, enabling gas flow to back side 156 of main burner valve 114 to maintain main burner valve 114 in the closed position.

Embodiments of the systems described herein achieve superior results as compared to prior art systems. For example, the gas flow controllers described herein include a valve decoupling mechanism that inhibits gas flow to a pilot burner and a main burner under abnormal operating conditions. In particular, the decoupling mechanism limits the amount of opening force that can be applied to a pilot valve upon actuation of a user input device, such as a knob. As a result, the pilot valves of the gas flow controllers described herein remain closed when the user input device is actuated and an elevated pressure condition exists on the inlet or upstream side of the pilot valve, preventing excessive or high pressure gas flow to the pilot burner and main burner. Moreover, by limiting the amount of opening force that can be applied to the pilot valve, the decoupling mechanism inhibits excessive stress on components of the gas flow controller that interconnect the pilot valve to the user input device.

Additionally, the gas flow controllers described herein include a flow controller valve which provides selective fluid communication between a gas inlet and the back side of a main burner valve. The flow controller valve is operable to open and close a fluid flow path from the gas inlet to the back side of a main burner valve. The fluid flow path is configured to permit sufficient fluid flow to the back side of the main burner valve such that the main burner valve remains closed even under abnormal operating conditions. Moreover, the decoupling mechanism operably connects the flow controller valve to a user input device used to open the pilot valve such that the flow controller valve is opened when the user input device is actuated. The decoupling mechanism is configured to open the gas flow controller upon actuation of the user input device, even under an elevated pressure condition, thus enabling gas flow to the back side of the main burner valve to maintain the main burner valve in a closed position regardless of the position of the pilot valve.

Example embodiments of gas fired appliances, such as water heater systems, and gas flow controllers for use in such gas fired appliances are described above in detail. The system and controller are not limited to the specific embodiments described herein, but rather, components of the system and controller may be used independently and separately from other components described herein. For example, the gas flow controllers described herein may be used in gas fired apparatus other than water heaters, including without limitation furnaces, dryers and fireplaces.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A gas flow controller for use in a gas fired apparatus including a pilot burner and a main burner, the controller comprising:

a pilot valve moveable between a closed position and an open position to provide selective fluid communication between a gas inlet and the pilot burner;

a main burner valve providing selective fluid communication between the gas inlet and the main burner;

an actuator configured to open the pilot valve upon actuation of the actuator;

a flow controller valve operable to open and close a fluid flow path between the gas inlet and a back side of the main burner valve upon actuation of the actuator; and a decoupling mechanism configured to connect the actuator to the pilot valve and to selectively disconnect the actuator from the pilot valve when the actuator is actuated and a pressure differential across the pilot valve exceeds a threshold pressure limit, wherein the decoupling mechanism prevents the pilot valve from opening when the actuator is actuated and the pressure differential across the pilot valve exceeds the threshold pressure limit.

2. The gas flow controller of claim 1, wherein the decoupling mechanism includes a shaft, an engagement member slidably connected to the shaft, and a biasing element configured to exert a biasing force on the engagement member.

3. The gas flow controller of claim 2, wherein the shaft includes a retaining element, the biasing element configured to bias the engagement member towards the retaining element, wherein the engagement member is configured to disengage the retaining element to operably disconnect the actuator from the pilot valve.

4. The gas flow controller of claim 1, further comprising an interconnecting member having a first end connected to the pilot valve and a second end distal from the first end, the interconnecting member configured to pivot about a fulcrum to open and close the pilot valve, wherein the decoupling mechanism is configured to engage the interconnecting member between the second end and the fulcrum upon actuation of the actuator.

5. The gas flow controller of claim 4, wherein the interconnecting member has an aperture defined therein and the flow controller valve includes a valve stem configured to engage a shaft of the decoupling mechanism to open and close the flow controller valve, wherein at least one of the valve stem and the shaft of the decoupling mechanism extends through the aperture defined in the interconnecting member.

6. The gas flow controller of claim 1, wherein the decoupling mechanism enables actuation of the flow controller valve when the actuator is actuated regardless of the pressure differential across the pilot valve.

7. The gas flow controller of claim 1, wherein the actuator is movable from a first position to a second position, the actuator configured to open both the pilot valve and the flow controller valve when the actuator is moved from the first position to the second position and the pressure differential across the pilot valve is less than the threshold pressure limit.

8. The gas flow controller of claim 1, wherein the actuator includes a manually depressible knob including a first end configured to be manually actuated by a user, and an opposing second end configured to engage the decoupling mechanism.

9. The gas flow controller of claim 1, wherein the main burner valve is located in fluid communication between the pilot valve and the main burner, and the flow controller valve is located in fluid communication between the pilot valve and the back side of the main burner valve.

10. A gas flow controller for use in a gas fired apparatus including a pilot burner and a main burner, the controller comprising:

a pilot valve moveable between a closed position and an open position to provide selective fluid communication between a gas inlet and the pilot burner;

a main burner valve providing selective fluid communication between the gas inlet and the main burner;

an actuator configured to open the pilot valve upon actuation of the actuator;

a flow controller valve operable to open and close a fluid flow path between the gas inlet and a back side of the main burner valve upon actuation of the actuator; and a decoupling mechanism interconnecting the actuator to the pilot valve, the decoupling mechanism configured to limit an opening force applied to the pilot valve upon actuation of the actuator, wherein the decoupling mechanism prevents the pilot valve from opening when the actuator is actuated and a pressure differential across the pilot valve exceeds a threshold pressure limit.

11. The gas flow controller of claim 10, further comprising an interconnecting member having a first end connected to the pilot valve and a second end distal from the first end, the interconnecting member configured to pivot about a fulcrum to open and close the pilot valve.

12. The gas flow controller of claim 11, wherein the decoupling mechanism includes an engagement member and a decoupling spring configured to bias the engagement member towards the interconnecting member, the engagement member configured to engage the interconnecting member between the fulcrum and the second end of the interconnecting member upon actuation of the actuator.

13. The gas flow controller of claim 12, wherein the decoupling spring limits the opening force applied to the pilot valve upon actuation of the actuator.

14. A gas flow controller for use in a gas fired apparatus including a pilot burner and a main burner, the controller comprising:

a pilot valve moveable between a closed position and an open position to provide selective fluid communication between a gas inlet and the pilot burner;

an actuator configured to open the pilot valve upon actuation of the actuator;

a main burner valve providing selective fluid communication between the gas inlet and the main burner;

a flow controller valve operable to open and close a fluid flow path between the gas inlet and a back side of the main burner valve upon actuation of the actuator;

an interconnecting member having a first end connected to the pilot valve and a second end distal from the first end, the interconnecting member configured to pivot about a fulcrum to open and close the pilot valve; and a decoupling mechanism including a shaft, an engagement member slidably connected to the shaft, and a biasing element configured to bias the engagement member towards the interconnecting member, whereby actuation of the actuator causes the engagement member to engage the interconnecting member between the second end of the interconnecting member and the fulcrum, and apply a limited opening force to the pilot valve.

15. The gas flow controller of claim 14, wherein the shaft includes a retaining element configured to inhibit movement of the engagement member along the shaft in a first direction, and permit movement of the engagement member along the shaft in a second direction opposite the first direction.

16. The gas flow controller of claim 15, wherein the engagement member includes a tubular member and an annular retaining lip extending radially inward from the tubular member, the retaining lip configured to engage the retaining element of the shaft to inhibit movement of the engagement member along the shaft in the first direction.

17. The gas flow controller of claim 14, wherein the decoupling mechanism enables actuation of the flow controller valve when the actuator is actuated regardless of a pressure differential across the pilot valve.

* * * * *